US006014819A

United States Patent [19]

Elder

[11] Patent Number: 6,014,819

[45] Date of Patent: Jan. 18, 2000

[54] PROCESS FOR TREATING GREEN WOOD

[76] Inventor: Danny J. Elder, Rte. 5, 110B, Kirbyville, Tex. 75956

[21] Appl. No.: 09/178,524

[22] Filed: Oct. 23, 1998

Related U.S. Application Data

[63] Continuation-in-part of application No. 08/859,848, May 21, 1997, and application No. 08/886,497, Jul. 1, 1997, Pat. No. 5,836,086.

[51] Int. Cl.[7] ..... F26B 7/00

[52] U.S. Cl. ..... 34/396; 34/417; 34/493; 34/497

[58] Field of Search ..... 34/396, 406, 413, 34/417, 443, 474, 475, 486, 493, 497; 428/541; 427/254, 315, 317, 325, 398.1, 440, 444; 144/335, 364, 380; 62/331

[56] References Cited

U.S. PATENT DOCUMENTS

| | | |
|---|---|---|
| 74,056 | 2/1868 | Davis . |
| 899,904 | 9/1908 | Reilly . |
| 987,888 | 3/1911 | Koenman . |
| 1,023,784 | 4/1912 | Marr . |
| 1,047,404 | 12/1912 | Goltra . |
| 1,051,596 | 1/1913 | Illingworth . |
| 1,328,656 | 1/1920 | Fish . |
| 1,396,899 | 11/1921 | Twombly et al. . |
| 1,785,571 | 12/1930 | Allen . |
| 1,810,659 | 6/1931 | Kritchevsky et al. . |
| 3,661,633 | 5/1972 | Moren . |
| 3,839,073 | 10/1974 | Hill . |
| 4,058,906 | 11/1977 | Pagnozzi . |
| 4,246,704 | 1/1981 | Pagnozzi . |
| 4,560,619 | 12/1985 | Yamada . |
| 4,893,415 | 1/1990 | Moldrup . |
| 4,922,624 | 5/1990 | Tharpe . |
| 4,927,672 | 5/1990 | Drinkard . |
| 4,953,298 | 9/1990 | Carter et al. . |
| 5,123,177 | 6/1992 | Koetter et al. . |
| 5,269,076 | 12/1993 | Breckenridge . |

OTHER PUBLICATIONS

Article in Souther Lumberman Dated Mar., 1982 by Eddie W. Price Entitled "Chemical Stains in Hackberry Can Be Prevented" (3 pages).

Article Entitled "Chemical Brown Staining of Douglas–Fir Sapwood" By Donald J. Miller, Donald M. Knutson, and Richard D. Tocher, Dated Apr., 1983.

"Rx For Sticker Shadow and Sticker Stain In Hard Maple Lumber", Dr. Eugene W. Wengert, Furniture Design & Manufacturing, May 1986, 2 pgs.

"Prevention and Cure for Sticker Stain (Shadow) in Maple, Ash, and Other Species", Virginia Tech's Products Center, Eugene M. Wengert, Feb., 1988 Note No. 10, 2 pgs.

"Prevention and Control of Sap Stain (Blue Stain)", Virginia Tech's Products Center, Eugene M. Wengert, Jan., 1988, Note No. 11, 2 pages.

(List continued on next page.)

*Primary Examiner*—Henry A. Bennett
*Assistant Examiner*—Steve Gravini
*Attorney, Agent, or Firm*—Bush, Riddle & Jackson

[57] ABSTRACT

A green wood treating process for treating wood in a green stage prior to curing for preventing or minimizing staining of the wood. The process includes the heating of green wood in a heating enclosure (30, 40) within a maximum time period after felling or cutting of the tree forming the wood while maintaining the moisture content in the wood after the tree is felled without any appreciable loss of moisture. After the logs are cut into lumber, the lumber is placed in bundles in the heating enclosure for heating preferably by steam within a predetermined time period. The wood is heated in the enclosure to a temperature over 120 F. for a predetermined time period generally over about two hours and sufficient to provide a generally uniform heating of the lumber. After heating of the wood to a predetermined temperature, a cooling fluid having a temperature substantially less than the temperature of the heating enclosure is applied to the heated wood for a predetermined time period.

21 Claims, 3 Drawing Sheets

OTHER PUBLICATIONS

"Control and Prevention of Chemical Stains (Interior Graying, Browning, and Pinking) and Iron Stain", Virginia Tech's Products Center, Eugene M. Wengert, Note No. 12, Mar., 1988, 2 pages.

"Sticker Stain, Sap Stain, and Wetwood Workshop", Gene Wengert, Virginia Tech's Products Center, presented Jan. 21–22, 1990, pp. 1, 2, 20–24.

John McMillen et al., "Drying Eastern Hardwood Lumber", Agriculture Handbook No. 528, pp. 2–10, 61–67 (Aug. 1990).

Eugene Wengert, Drying Oak Lumber, University of Wisconsin–Madison, pp. 54–60, 112–115 (Aug. 1990).

"Drying Maple Lumber", Eugene Wengert, Aug. 1990, pp. 43–51.

"Dry Kiln Operator's Manual", William T. Simpson, Agricultural Handbook 188, Revised Aug. 1990, pp. 7–16, 43–50, 215, 219–233.

"Lumber Defects Caused by Insects, Fungi, and Chemical Stains", H.B. Moore, et al., Agricultureal Extension Service, North Carolina State University, pp. 46, 47, 50, 51, 52, 53, published before 1991.

"Chemical Stain and Stain Control In Hardwood Lumber Drying", Virginia Tech, Blacksburg, VA, Eugene M. Wengert, Published before 1992, 2 pages.

"Cures For Stain, Part One: Sticker Stain", Gene Wengert, "The Northern Logger & Timber Processor", published before 1992, 1 pg.

"Tech Talk Cures For Stain: Sap Stain", Gene Wengert, The Northern Logger & Timber Processor, published before 1992, 1 pg.

Brochure Entitled "Timber Drying Course" Dated Mar. 23–27, 1992 (6 pages).

Article From Forest Products Journal, vol. 44–No. 10, Oct. 1994 Entitled "Methyl Bromide Fumigation To Control Non–Microbial".

"Fungal Removal of Wood Sapstain Caused By Ceratocystis Coerulescens" Suki C. Croan and Terry L. Highley, USDA, Forest Service, Madison, Wisconsin, Aug. 25, 1995, pp. 45–56.

"Industry Dateline", *Lumberman,* May 1996, pp. 12, 13.

"Hardwood Research Bulletin", Mar. 1997, No. 482, pp. 1–4.

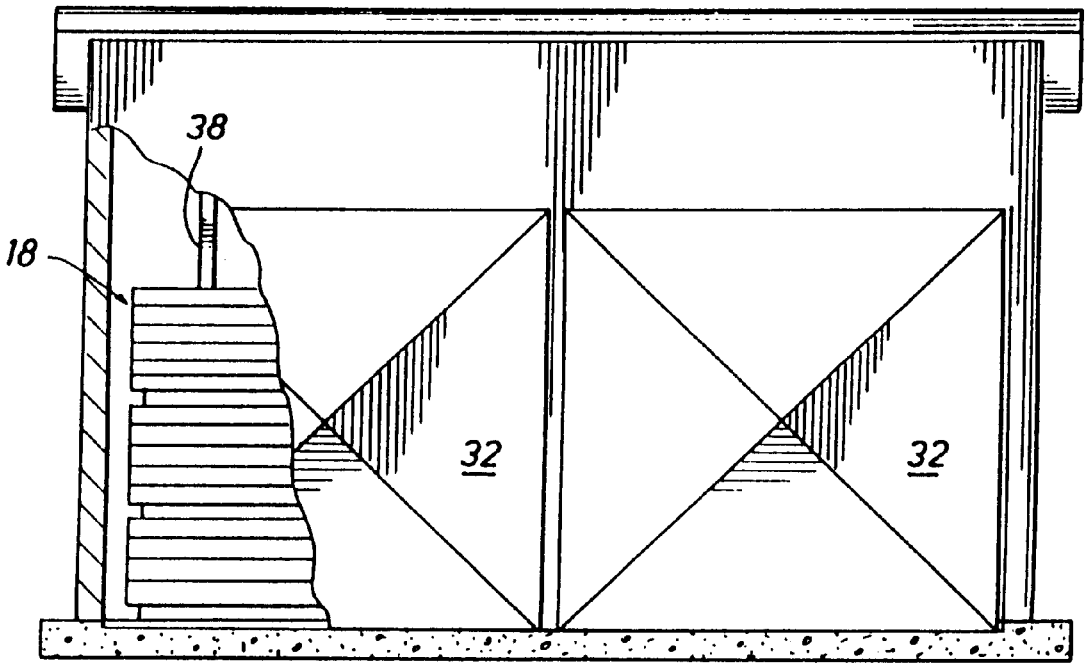
FIG. 4
FIG. 5
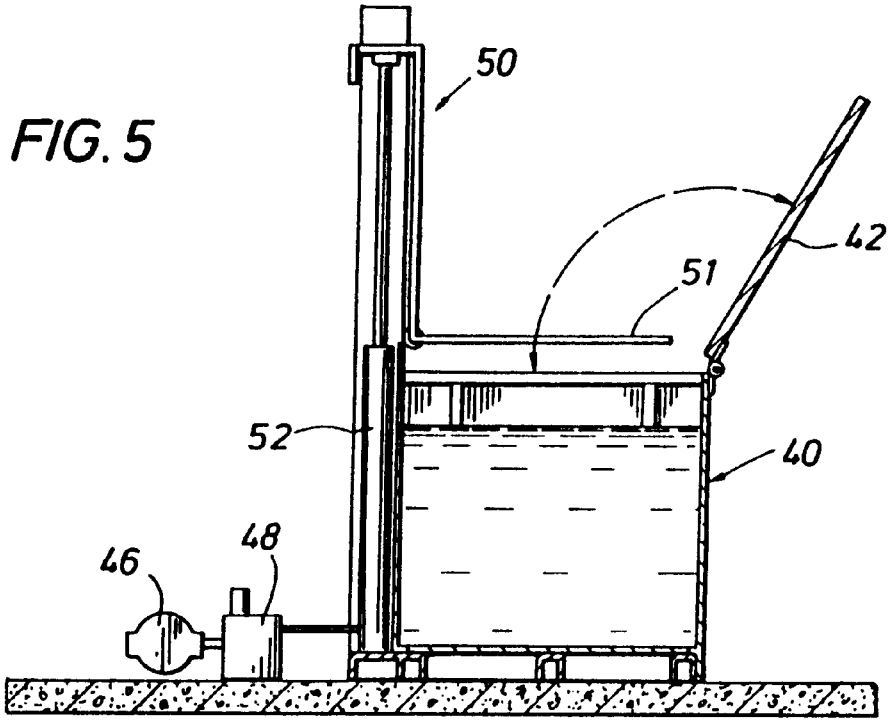

PROCESS FOR TREATING GREEN WOOD

REFERENCE TO RELATED APPLICATIONS

This application is a continuation in part of application Ser. No. 08/859,848 filed May 21, 1997, and a continuation in part of application Ser. No. 08/886,497 U.S. Pat. No. 5,836,086 filed Jul. 1, 1997.

FIELD OF THE INVENTION

This invention relates to a process for treating green wood, and more particularly to treating green wood prior to the curing or drying of the wood for minimizing staining of the wood prior to fabrication into various wood products such as furniture.

BACKGROUND OF THE INVENTION

All woods have a fibro-vascular tissue composed of cellulose and its components belonging to the subdivision called spermatophytes (IV) in the plant kingdom (with the single exception of tree ferns). The spermatophytes can be further subdivided into two classifications; gymnosperms or "softwoods" and the angiosperms or "hardwoods". It must be emphasized that the terms softwood and hardwood have no bearing on the density or degree of hardness of such woods but moreover refers to their classification. Some woods that are classified as softwoods, such as yellow pine, are physically harder than some woods that are classified as hardwoods such as aspen or basswood. Further, angiosperms can be again divided into very distinct classes: the monocotyledons or the palms, bamboos, canes and grasses and the dicotyledons (the majority of angiosperms that provides us with useful woods).

Since a living tree contains very large amounts of water, lumbermen often refer (at various stages from the initial cutting of a tree up through the sawing and drying of lumber) to the moisture content (MC) of the wood. The moisture content of the wood, usually expressed in a percentage, is a ratio of the amount of water in a piece of wood that is compared to the weight of such wood when all of the moisture has been removed. One of the methods that is employed (the "moisture content on the oven-dry basis") to determine the MC of wood at any stage during the lumber production process is to weigh a given sample of wood and record such weight (the "wet weight"). The sample is then placed into an oven and heated (at temperatures not to exceed 217 F.) until all of the moisture has been removed (the "oven-dry weight") and that weight is recorded. It can be determined that the oven-dry weight has been reached when, after weighing at various intervals, the sample stops losing weight. The oven-dry weight is then subtracted from the wet weight and the resultant is then divided by the oven-dry weight. That resultant figure is then multiplied by 100 to determine the percentage of MC. The formula can be represented as follows:

$$\% \ MC = \frac{(\text{wet weight} - \text{oven-dry weight})}{\text{oven dry weight of wood}} \times 100$$

The type of units employed for the above calculation, i.e. ounces, grams, pounds, kilograms, etc., is not important as long as all weights are recorded in the same type of units since the calculations are based upon a ratio of such weights. Other methods of determining MC have been developed as well as electronic machines that compute the MC based upon known electrical and other reactions. Regardless of the method employed to determine such MC, a working knowledge of moisture content and how it effects wood is important to the present process.

When a hardwood tree such as red or white oak, ash, maple, poplar, or any one of the many species of hardwoods that are used in the production of wood products is initially cut down, it has a MC of anywhere from about 60% to 100% (this moisture content has been found to be even higher, as much as about 150% for some softwoods). This is called the "green moisture content". This moisture or water has to be removed or dried from the wood in order to make the wood usable in any phases of the hardwood lumber industry that require either air dried and/or kiln dried lumber. The drying or curing of hardwoods thus comprises the controlled removal of water from the wood to a level (approx. 6% to 8% MC) where the wood becomes sufficiently stable for fabrication into various products. However, the present green wood treating process is performed prior to the drying or curing process. Although in some instances the cooling of the wood after heating for a predetermined time may be confused with a kiln drying schedule, the "curing" process or "curing" as used herein refers to moisture removal by the controlled act of air drying, kiln drying, or a combination of both.

After a tree is felled and is sawn into lumber of various sizes and types, it is stacked in a particular manner in preparation for the drying and/or pre-drying process. During this pre-drying or drying period, many problems may occur that can either damage, destroy or degrade the quality of the wood and render it less desirable and in some cases, not usable. The sawn lumber can develop cracks in the ends ("end checks"), cracks in internal portions of the lumber ("honeycomb" or "honeycombing"), cracks in the surface ("surface checking"), as well as many types of warps and bends ("cup", "bow", "crook", etc.). In addition to these problems, the sawn lumber can develop several types of stains and discolorations. During the history of the development of the technical aspects of lumber drying, most of the above mentioned problems have been handled somewhat by controlled drying and the application of chemicals during the drying process except for two very troublesome classes of stains, sap or blue stain caused by a fungus and chemical stains caused by the action of enzymes that are contained in the wood. These stains normally occur between the time that the tree is felled and prior to the beginning of, and during, the drying processes.

Blue stain is a fungal stain that occurs in the sapwood of the tree. Although the tree has several very distinctive layers that make up its cross-section, there are two broad areas known as "sapwood" and "heartwood". The sapwood comprises the living layers (parenchyma cells), growing layers (cambium layer) and semi-dormant cells which occur in the life processes of the tree that surround the central portion or heartwood of the tree. The heartwood contains stabilized cells that are hardened and laden with tannin, natural chemicals and resins. The stability of the cells in the heartwood and the presence of tannin, as well as the lack of the sugars and starches, minimize any intrusion of discolorations due to the blue stain and the chemicals stains in such heartwood cells.

Blue stain is currently believed to be caused by fungal activity which is promoted by four main elements. Those elements are: a) temperature above 50 F. (a reason that blue stain is more troublesome in the southern United States); b) presence of oxygen; c) presence of moisture; and d) presence of sugar and starch occurring naturally in living cells of the sapwood (parenchyma cells). It is commonly held that the elimination of one of these elements will control blue stain although the control of these elements is very difficult and therefore, rather ineffective.

Chemical stains such as sticker stain, sticker shadow and interior graying also only occur in the sapwood and are caused by the oxidation of enzymes that are present in the parenchyma cells of the sapwood fibers. Effective measures to control the chemical stains include controlling the of oxygen to the sawn lumber and completing the drying cycle of the wood as quickly as possible. However, a precise oxidation of the sawn lumber is difficult to achieve and control.

For blue stain or fungal stain, there are various chemical cures for this problem but these methods generally have been found to be expensive and harmful to the environment. Blue stain and chemical stain result in a major expense to the lumber industry. The present invention is directed to the treating of green wood prior to curing.

It is an object of the present invention to provide a process for treating green wood which minimizes or eliminates blue stain and chemical stains in the wood.

SUMMARY OF THE INVENTION

The process for treating green wood prior to curing includes the use of a fluid heating medium such as water, steam, or other such suitable medium, that elevates the internal temperature of either sawlogs or sawn lumber to a temperature of at least 120 F. and maintains such sawlogs or sawn lumber at such elevated temperature for a predetermined time dependent primarily on the level of such temperature, and the type of wood being processed. The green wood treating process is performed within a maximum time period after the tree from which the wood is cut has been felled or cut from the forest so that the original moisture content (MC) is generally maintained within the wood prior to the heat application of the green wood process. This maximum time period prior to the heating step is referred to as the "Processing Internal". Further, the original moisture content (MC) is generally maintained within the wood during the application of the green wood process comprising the present invention by a continuous wetting or water spraying of the green wood prior to the heating step. As indicated, the MC of a log when felled is normally between about 60% to 100%, although it is substantially higher for some woods, particularly softwoods.

While the green wood process of the present invention may be performed satisfactorily with some loss of MC prior to the heating step, only a relatively small loss can be sustained. Some species of wood are more tolerant of moisture loss than others. For example, tests on southern oak have shown that it can sustain a moisture content loss of about 3% to 5% without problems (for the climate/geography of the processing facility). However, other hardwoods (including other varieties of oaks in other regions) have illustrated an ability to sustain higher percentages of moisture content loss with no ill effects. The factors that determine the amount of moisture content loss that are sustainable and still have successful results with the present process are: a) difference in species of wood, b) geographic, c) climatic factors, d) sawmill procedures used, and e) kiln drying procedures used for the curing process. When the logs are not wetted, the lumber cut from such logs should not have a substantial or appreciable loss of moisture after cut from the logs (less than about 8% for most woods and in any event less than about 12%) before being heated.

The logs or lumber may be sprayed with water to maintain the moisture content during the "Processing Interval" but normally lumber would not be wet. Before the logs are cut into lumber, the logs are maintained in a wet condition by wetting or spraying with water. This is considered essential in maintaining the moisture content of the logs prior to cutting into lumber. The Processing Interval can be extended through the use of artificial or natural means, i.e. refrigerated storage; vacuum storage; cooler temperature and lower humidity conditions at and during storage; immersion in chemical solutions; immersion in water; cutting, handling and storage in cooler climates; semi-permeable coating; and other means to prevent the subject wood from being exposed to the conditions in which, chemical and enzymatic stains can develop. The Processing Interval can be determined from a combination of the following factors (unless the Processing Interval is altered by artificially or naturally controlling such factors): a) geographic, b) climatic, c) species of wood to be processed, d) storage air temperature, e) storage relative humidity, f) storage method employed and g) other related sawing and handling methods of a given facility. The continuous wetting of logs from the time that they are felled until such logs are sawn into lumber and heated is for preventing the stains from damaging the wood prior to processing. Even though further staining will be stopped with the present process, any stain damage that has occurred in the wood to be heat processed will not be removed by the heat process.

The preferred fluid media for this process are water and steam. However, other types of media may be utilized, i.e. glycerine, propylene glycol (and solutions thereof), ethylene glycol (and solutions thereof), some types of oils, etc., that might also provide the desired heating effect without adversely affecting the properties of the lumber being processed. Water and steam preferably are used as they are relatively inexpensive, environmentally safe, and readily available to maintain the original moisture content.

Another important feature of this green wood treating process includes the cooling of the green wood by ambient air. The wood is heated in the heating enclosure preferably by steam for a period generally less than about five (5) hours, or preferably less than about three (3) hours, after the predetermined temperature over 120 F. has been reached. During heating the moisture content is maintained by the application of steam so that any loss of moisture during heating is less than three (3%) percent. Then, after heating of the wood in the enclosure is completed the heated wood is exposed to air cooling within a very short time period generally less than about twenty (20) to thirty (30) minutes after the wood is heated to the predetermined temperature for a predetermined time period.

The present process for treating green wood prior to curing has been found to be highly effective in preventing staining of the wood, particularly hardwoods.

Other objects, features, and advantages of the invention will be apparent from the following specification and drawings.

BRIEF DESCRIPTION OF THE DRAWINGS

FIG. 4 is a front elevational view of the enclosure shown in FIG. 3;

FIG. 5 is a side elevational view of an enclosure or tank for heating logs immersed within hot water within the tank;

DESCRIPTION OF THE INVENTION

The layers of a typical tree are the: a) the outer bark; b) the inner bark; c) the cambium layer; d) the sapwood and e) the heartwood. The outer bark is a rough textured layer composed of dry, dead tissue that provides the tree with its first line of defense against external injury and insect infestation. The outer bark is separated from the next layer called the inner bark by a thin layer called the bark cambium. The inner bark is a soft, moist layer that contains living cells that play a role in the transfer of food to the growing parts of the tree. The cambium layer is a very small layer that is just inside the inner bark. Its main function is to produce both bark and wood cells. The sapwood is composed of light colored wood and is made up of both living and dead tissues. The sapwood carries sap from the roots to the leaves. the heartwood is the central section of the tree that is laden with resins and tannins and is basically inactive. Heartwood is formed by the transformation of sapwood as the tree ages. The present invention is directed primarily to the sapwood layer.

Both the sapwood and the heartwood are composed of many layers or "rings". These are called annual rings and each one represents the amount of growth a tree undergoes for a given year of its life. The sapwood layer is the part of the tree that is subject to both fungal and enzymatic staining. The heartwood portion of the tree is not normally susceptible to these two types of stains because of the incident of resins and tannins that are prevalent in such heartwood.

Figure 1:
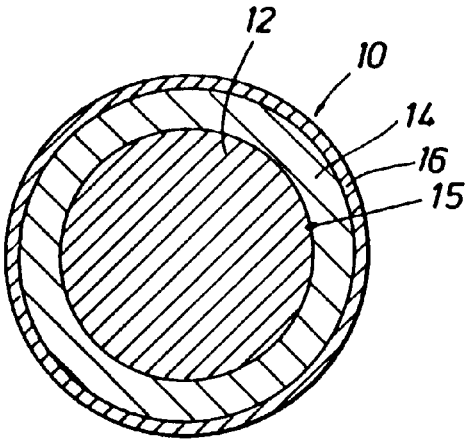
FIG. 1 is a cross sectional view of a log showing the sapwood layer about the center heartwood.
Figure 2:
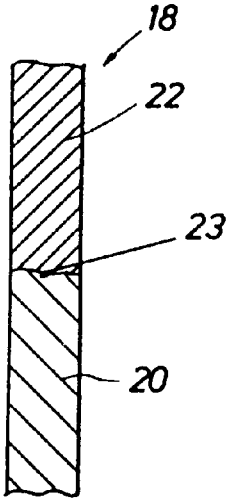
FIG. 2 is a cross sectional view of a piece of lumber which has been cut from the log shown in FIG. 1.

Referring to FIG. 1, a cross section of a log is shown generally at 10 having a center heartwood 12 and a sapwood layer 14 about the center heartwood 12. An outer cambian layer or ring 16 about 1/16 inch in thickness extends about sapwood layer 14. A typical log 10, for example, may be about eighteen (15) inches to twenty four (24) inches in diameter. Sapwood layer 12 normally has a moisture content (MC) of about 60% to 100% for hardwoods and about 90% to 150% for softwoods when log 10 is cut or felled. In the event the temperature of log 10 is measured for heating of log 10 to a predetermined amount, a temperature probe is inserted at 15 between heartwood 12 and sapwood 14.

A piece or board of hardwood lumber is shown generally at 18 which has been cut from log 10. Hardwood lumber 18 may include heartwood 20 and sapwood 22. In some instances, lumber 18 may be entirely sapwood or entirely heartwood. While staining normally occurs only in the sapwood portion 22 and not in the heartwood portion 20, lumber 18 is normally not screened and all of the lumber undergoes the green wood treatment process of the present invention. In the event the temperature of lumber 18 is measured for the heating of lumber 18, the temperature is taken at 23 at the interface between the sapwood portion 22 and heartwood portion 20.

Figure 3:
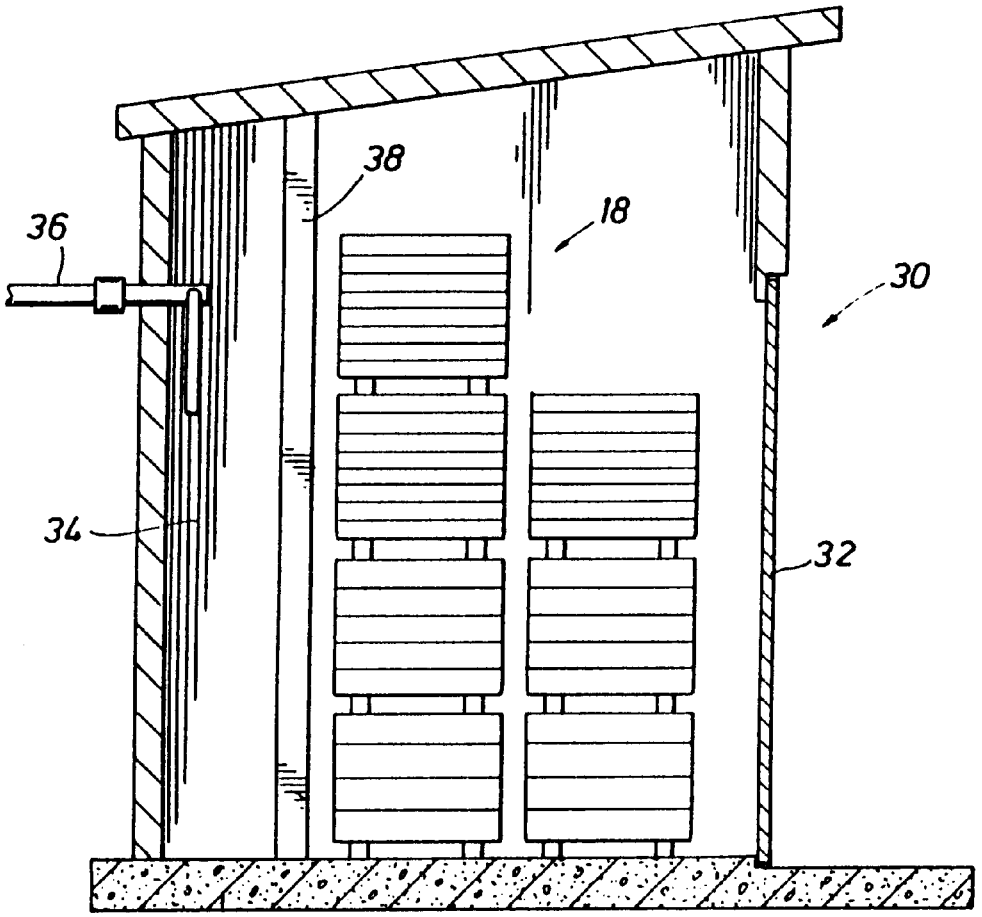
FIG. 3 is a side elevational view of a suitable enclosure for steam heating of stacked lumber within the enclosure.

Referring to FIGS. 3 and 4, an enclosure is shown at 30 for heating of lumber with steam. Enclosure 30 includes a pair of front doors 32 for entry into the enclosure and a rear steam chamber 34 having a steam line 36 extending thereto for the supply of steam. Sawn lumber 18 is stacked against vertical spacers or bumpers 38 to allow optimum penetration of the steam to all surfaces of the stacked lumber during processing. The enclosure 30 is then tightly closed by doors 32 and steam is injected through line 36 into the enclosure through steam venting that is placed so as to create little or no velocity of air flow. It is essential that little, if any moisture content of the lumber being processed be lost. During the processing period, the relative humidity is constantly monitored. The relative humidity can be determined and monitored by several different methods employing different types of equipment, any one of which would probably be effective. A common method to determine relative humidity is by the use of a wet-bulb thermometer simultaneously with a dry-bulb thermometer. A wet-bulb thermometer is a standard thermometer that has the sensor portion covered by a muslin wick that is kept wet with water. A dry-bulb thermometer conversely is the same temperature sensing device less the wet muslin wick. By monitoring the difference in temperature between the wet-bulb and dry-bulb thermometers (the "wet-bulb depression") and knowing the dry-bulb temperature, a chart can be consulted to determine the relative humidity of the air.

The relative humidity ("RH") is the ratio of the maximum amount of water that is in the air compared to the maximum amount of water that the air can hold at the same temperature. When the wet-bulb depression is at "0", then the air has a RH of 100% or a level at which all of the water that the air can hold at that temperature, therefore no evaporation or moisture transfer should take place and subsequently no moisture loss should occur in the wood being processed. Constant monitoring of the wet-bulb depression is provided to insure that there is as near a zero (0) depression between the wet bulb and dry bulb thermometers as possible (other methods to monitor and control to between 95% and 100% RH would also be effective). As the internal temperature of the lumber being processed rises to the desired temperature level above 120 F. and for the time period determined by such level of temperature, then such lumber should be removed from enclosure 30 and allowed to cool in the open air. Such immediate removal of processed lumber as opposed to allowing the wood to cool down slowly before removal has been found to be very effective. The ends of the processed lumber are coated with wax to prevent end checking (or such other suitable coating for the prevention or retardation of end checking) or re-coated with wax if they were previously coated. The processed lumber is then moved to the pre-dryer fan shed or other related area for normal pre-drying procedures for the curing process, and then kiln dried according to the kiln drying procedures for the associated geographic area.

Testing has shown that the temperature increase of the wood from 120 F. and higher during the heat treating step is a direct function of the time such wood is held at that temperature. Consequently, processed wood that, due to its species, geographic location, etc., has been determined to require a processing temperature of 135 F. might take a considerable longer time held at that temperature than a wood type and class that is heated to 180 F. There are, however, some optimum ranges for economical commercial operation that have been determined for processing facilities in east-central Texas and its corresponding wood types. It has been determined that the best and most economic results have been derived with southern oak by using processing temperatures of between 155 F. and 180 F. for sustained time periods of from zero normally up to three (3) hours holding time at the processing temperature prior to removal from enclosure 30 or exposure to a cooling fluid. It may be desirable in some instances to have a long heating time, such as 25–50 hours, for certain woods for purposes such as colorization, for example.

Steam may also be utilized to process wood in the log form by following the same procedure. The obvious exception is that the stacking process is different as a result of the different shape of round logs of varying diameters. Suitable racks (not shown) may be utilized to hold the logs in multi-level rows thereby allowing maximum steam penetration. The logs should be kept wet prior to positioning within the steam enclosure. The actual processing procedure is generally the same as the procedure for lumber as set forth above. After the interior of the deepest sapwood of the largest diameter log is brought to the temperature level above 120 F. or higher and held at that temperature level for the time period appropriate for such temperature level (monitoring constantly to avoid moisture content loss in the logs), the logs are then immediately removed from the steam enclosure and allowed to cool in the open air. The processed logs are then sent on to the sawmill area for sawing into lumber, waxing the ends to prevent end checking and stacking and "stickering" for the normal pre-drying procedures and subsequent kiln drying for a given geographic area.

Figure 6:
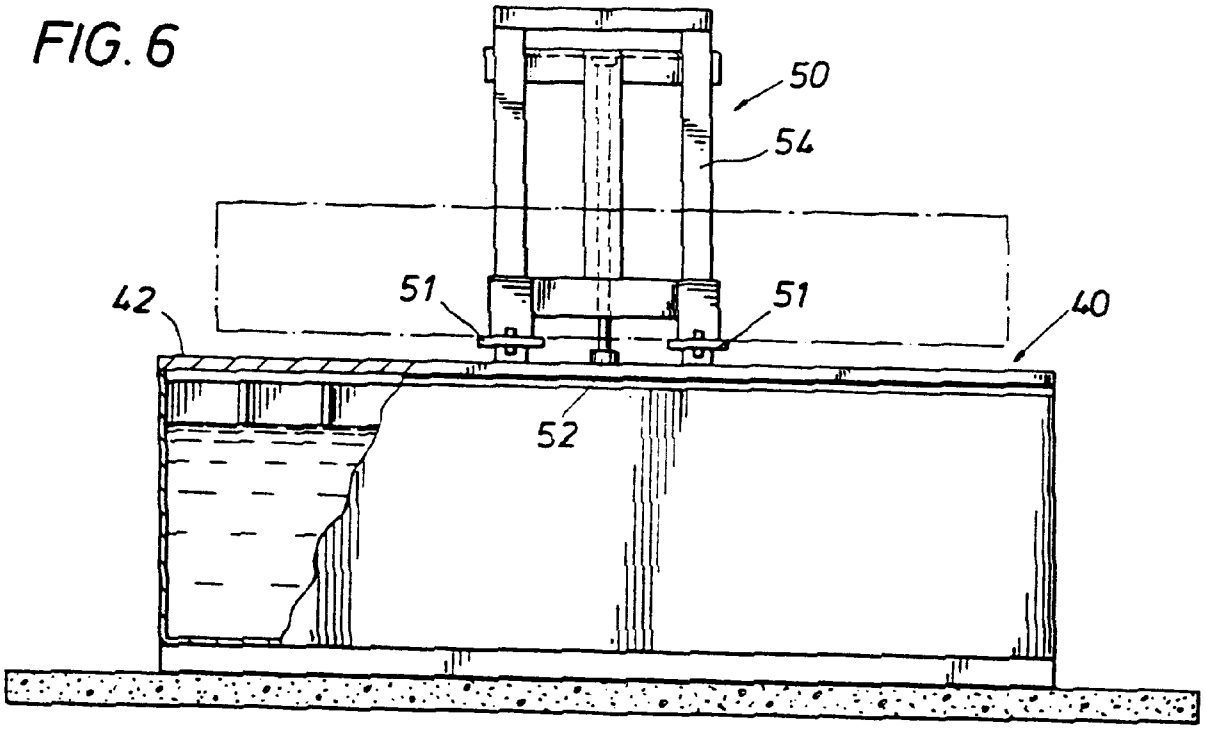
FIG. 6 is a front elevational view of the tank shown in FIG. 5.

Referring now to FIGS. 5 and 6, another apparatus embodiment is shown for the heating of logs 10 by immersion in heated water. A water containing enclosure or processing tank is shown generally at 40 having a pivoted insulated cover or top 42 which is counterweighted for pivoting between open and closed positions. To lower logs 10 within tank 40, a fork lift shown generally at 50 is provided having tines 51 for supporting logs 10. A hydraulic ram 52 is connected to frame 54 for raising and lowering tines 51 and logs supported thereon. A hydraulic fluid reservoir 48 and pump 46 supply hydraulic fluid to ram 52. The logs 10 should be kept continuously wet prior to the heat processing step unless a log is cut into lumber preferably within about three days after the tree is felled, or within a maximum of six (6) days after the tree is felled. The lumber normally is not wetted.

After processing tank 40 is completely loaded and the water level is adjusted for the displacement of the logs, the water which was pre-heated prior to loading of the logs, is now continuously heated using either boiler, steam heating methods or an alternate water heating method, until the internal temperature of the sapwood of the largest diameter log reaches the predetermined temperature level above 120 F. and held for the appropriate time period of such predetermined temperature. The temperature of the log is taken at the interface 15 between the heartwood 12 and sapwood layer 14 as shown in FIG. 1. In the submerged log process, moisture loss during heating is not as critical as in the steam heating step since no evaporation or moisture transfer from the logs should occur when the logs are submerged in water. The processed logs are removed and taken to the sawmill for sawing into lumber. Then the ends of the lumber are waxed to prevent end checks and the lumber stacked and "stickered". After logs have undergone the treating process the sawn lumber from the logs does not require any further treatment. The sawn lumber can then be exposed to normal air and kiln drying processing as usual for a given geographical area. Processing tank 40 could be located below ground level, if desired, both to facilitate loading and unloading and to use the insulating qualities of an underground location.

Processing tank 40 utilizing water as a fluid heating medium may also be used on sawn lumber with a predetermined Processing Interval for lumber. The sawn lumber of uniform thickness is stacked with spacing between the individual boards and precisely sized and positioned spacer boards ("stickers") are provided between the layers so that the boards are spaced from each other. The individual boards are banded together and placed in the pre-heated water to be brought to processing temperature. The remainder of the process is generally the same as for processing logs. After the predetermined temperature above 120 F. is reached and held for the appropriate time for such pre-determined temperature, the lumber is then removed and cooled. The ends of the lumber are waxed to prevent end checks and the lumber is then processed by normal pre-drying and drying procedures.

The above described apparatuses use enclosures for steam and water as fluid heating media for the heating step of the green wood treating process. In some instances it may be desirable to utilize an enclosure or pressure vessel in which a positive or negative pressure is applied. In this event, the lumber or logs are positioned within a pressure vessel (not shown) with a pressure tight seal for positive pressure and steam or water is injected into the chamber at a predetermined pressure depending upon the desired temperature and time range. Since saturated steam or water is used under pressure, the moisture content loss is minimal and the wood is removed as soon as the unit pressure is reduced to a predetermined amount. Since an increase in pressure causes an increase in temperature and a decrease in the amount of time required for holding at such temperature occurs. For a negative pressure within a pressure vessel, the decrease in pressure causes a corresponding decrease in temperature and would normally increase the length of time required for completing the heating step. The specific design of the pressure vessel may be determined by one skilled in the art.

It is recognized that the utilization of any of the above described apparatuses for using water or steam or other suitable heating media could be performed on either lumber or logs. It is further recognized that different facilities might better utilize one heating medium more than the other, or a heating facility might prefer to use a fluid medium other than water or steam. Regardless of the heat transfer medium used, the type and design of processing equipment, or the temperature level and corresponding holding time, the steps in the present green wood treating process are similar as long as the logs are kept wet and/or cooled until processed, and the lumber being processed is from continuously wet cooled logs that have been sawn within the parameters of the Processing Interval. Thus, there is no appreciable loss of moisture content for the processed logs or lumber during such processing.

TYPICAL PROCESSING RUN

The general steps for a typical green wood processing run for lumber under the present process comprise the following:

Arrival and Storage of the Logs

After specifying to the logger that the logs have been cut within a predetermined time period, the logs arrive and are immediately unloaded in the sprinkling area. There they are kept continuously wet on all surfaces (if possible). Test cuts are made on any exposed (de-barked) areas and ends to see if staining has began. Logs that show signs of damage (bark) or any other signs of staining are sent first to the sawmill to be sawn for lumber. Un-wet logs are normally cut within three (3) days of arrival when the temperature is over 50 F. and the relative humidity is over 40%.

Sawing into Lumber

The log is then placed on the conveyor to be sent to the saw for dimension cutting. As each board is cut from the log, it is cut and trimmed by various saws. The trimmed boards then go by conveyor belt to an end trimmer where the ragged ends are cut from both ends to some pre-determined length.

The trimmed boards are graded and stacked (stickered) with small sticks set at precise intervals to allow circulation between the layers and also between each board on a given layer. After the bundles of stacked lumber reach an cptimum size, the bundles are taken to a shaded holding area (where there is little air circulation). The ends of each bundle are sprayed with a special form of wax that aids in the prevention of end checking or splitting of the wood on the ends. The bundles are taken into the heating enclosure for the heating step as soon as possible. A relatively short term period, such as about thirty (30) minutes for example, is required to complete the sawing, sorting and stacking process depending upon equipment.

Heating Step

After the bundles are loaded into the heating enclosure 30 and doors 32 and hatches are firmly secured to minimize heat loss, the heating step commences. Two time periods are involved within the heating enclosure; (1) the time (T3) taken to heat the wood to the predetermined or target temperature, and (2) the time (T4) such lumber is held at the target temperature for proper processing as will be explained further. The optimum holding time is between about two (2) to three (3) hours. A heating period of at least about two (2) hours is preferable to minimize any staining of the wood. As stated, the time (T3) taken to heat the lumber to the target or predetermined temperature is a function of the amount of lumber that is being processed (that is absorbing heat) as well as a function of the size of the steam boiler that is being utilized. For example, for time involved to attain the target temperature is about one (1) hour per every 1,000 board feet being processed with the target temperature of about 160 F. and an ambient outside temperature of about 75 F.

If desired, at this point certain or various solutions could be sprayed or atomized into the heating chamber, thereby uniformly coating the processed wood to effect certain desirable effects in the surface of such processed wood. An example of this could be the injection of a fungicide to help prevent some forms of surface molding that can occur during the pre-drying of processed wood. After such processed wood is uniformly coated with the subject solution, you could then proceed to the next step.

Cooling or Flash Off Period

The flash off or cooling period involves the time period (T5) that the wood is exposed to a cooling fluid, such as air, after the steam is shut off and the doors are opened allowing the large build-up of moisture and steam vapor to escape into the atmosphere. This rapid cooling effect enhances the present invention. Within about 5 to 10 minutes from the time that the doors of the heating enclosure are opened, most of the heated excess moisture and steam vapor have evaporated thereby producing a cooling effect on the lumber. The processed wood or lumber is reduced from the target temperature to a cool-to-the touch temperature resulting from evaporation in a relatively short term period, such as five (5) to ten (10) minutes. Each bundle is then re-coated with the special wax that prevents end-checking (splitting) in the wood. This is necessary since the high temperature of the heating step causes the wax to melt and render it ineffective. Therefore, the wax should be re-applied to continue to provide the protection that such wax affords. The lumber bundles are then taken to the pre-drying shed for normal pre-drying procedures.

The cooling period may also include the transmitting of a cooling fluid through the enclosure 30 in which the lumber is heated. The cooling fluid is circulated about the bundles which have been stickered as shown in FIG. 3 to space individual boards from each other so that the cooling fluid substantially surrounds each board to provide a highly effective cooling action for evaporation of the heated excess moisture and steam vapor. The cooling fluid which preferably comprises air has a temperature at least 30 F. below the temperature of the heated lumber. The cooling fluid has a relative humidity at least about 10% less than the relative humidity of the heating enclosure and preferably about 30% less than the relative humidity of the heating enclosure. For best results the heated lumber is exposed to the cooling fluid as quickly as possible after the heating step has ended and before the lumber loses any substantial heat such as within (30) minutes after the heating step has ended. A thermometer determines the temperature of the air. The temperature of the lumber may be determined by a temperature probe embedded in the lumber and extending to the center of the wood. Fans may be utilized for drawing in ambient air as the cooling fluid. Doors to the heating enclosure may also be opened to permit an air flow across the heating enclosure 30. The application of a cooling fluid includes the exposing of the wood to ambient air as well as the positive circulation of a cooling fluid.

Time Periods For Green Wood Treating Process

Figure 7:
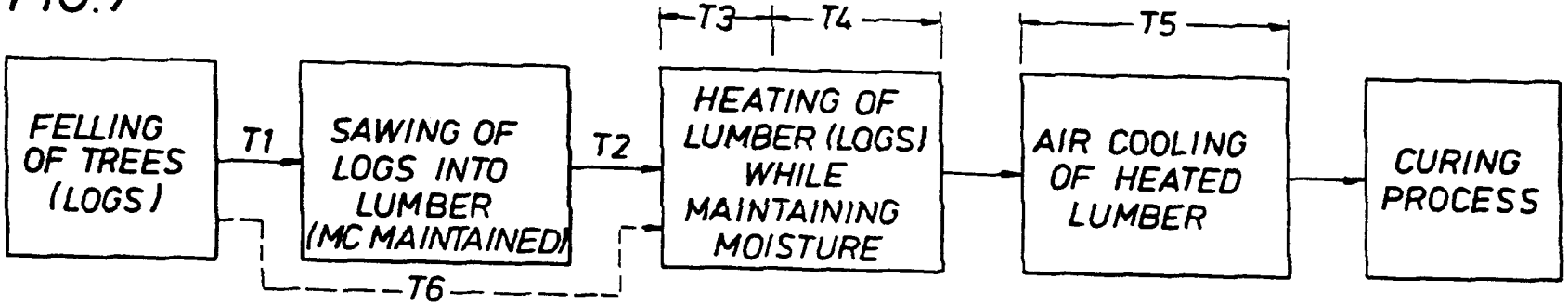
FIG. 7 is a schematic view of the steps of the preferred process for treating green wood.

Referring now to FIG. 7, a diagrammatic view of the sequential steps for the green wood treating process of this invention as set forth above is shown. The time periods between the various steps and the time periods required for certain steps have been denoted as T1, T2, T3, T4, T5, and T6. The "Processing Interval" for lumber comprises T2 while the "Processing Interval" for logs comprises T6. The time periods between the steps and for accomplishing the heating step and the air cooling step are important and essential in certain instances for eliminating stains prior to the curing process.

T1–T6 refer to the following time periods:

T1—Time period or duration from the time tree is felled or cut in the forest until logs are sawn for lumber.

T2—Time period or duration from the time log is cut into lumber until lumber is heated (Processing Interval for lumber).

T3—Time period for the heating of lumber to the predetermined temperature in an enclosure.

T4—Time period for maintaining predetermined temperature in the enclosure after the wood reaches the predetermined target temperature.

T5—Time period for air cooling of lumber or logs after heating.

T6—Time period or duration from the time tree is felled in the forest until logs are heated when not sawn into lumber (Processing Interval for Logs).

Time Factor T1

This time factor represents the time duration between the time that a log has been cut until the time that it is sawn into lumber. The maximum time period (T1) allowable if the logs are not wetted is about six (6) days when the temperature (average daily) is over 50 F. and the average daily relative humidity is over 40%. The time period T1 can be extended substantially indefinitely by keeping the logs completely wet by the constant spraying method or submerged the logs in water. Preferably, the logs should be cut into lumber as soon as possible.

Time Factor T2

This time factor is the elapsed time from the sawing of the log into lumber until such lumber is heated. Time factor T2 is probably the most important time factor and has to be carefully monitored. At average daily temperatures over 50 F. and average daily relative humidity at 40% and higher, the maximum amount of time normally allowable for T2 is approximately five (5) days with an optimum time T2 being immediately after sawing of the log into lumber. However, under certain conditions with the moisture content of the lumber being maintained without any appreciable loss of moisture (less than 8%), T2 may be a maximum of five (5) days for certain woods.

The conditions that promote stain particularly in green logs and lumber are high temperatures (over 50 F.) and high humidity.

Time Factor T3

The time factor (T3) involves the heating of the lumber (or logs) to the target or predetermined temperature that has been determined as the optimum temperature for a given species under specific geographic and climatic conditions. The time needed for T3 is partially a function of the amount of lumber loaded in the enclosure that has to absorb the temperature after the predetermined temperature has been reached.

Time Factor T4

The time factor (T4) involves the time period that the processed lumber (or logs) are held at the predetermined temperature in the heating enclosure. An optimum time period for T4 is between about two (2) and four (4) hours. The maximum time period for T4 is normally less than about eight (8) hours. For treating under this process, the time period T4 would not obtain any additional benefit if extended beyond eight (8) hours; however, time period T4 could be extended beyond eight (8) hours with satisfactory results. Practically, T3 and T4 combined should not exceed about eighteen (18) hours in any event. The temperature of the heating enclosure has been found to be of an optimum of between about 160 F. and 190 F. for best results. Under certain conditions, a temperature as high as about 210 F. or higher may provide satisfactory results.

Time Factor T5

Time factor T5 is the time period the wood is exposed to cooling fluid after the wood is heated to the predetermined temperature for a predetermined time. A term adopted for this step is "flash off" because the lumber is dripping with moisture and has steam vapor coming off of it. The wood is exposed to the cooling fluid within a relative short time period after the wood has been heated to the predetermined target temperature, such as 160 F., for example. For best results, the heated wood is exposed to the cooling fluid as quickly as possible and before the wood loses any substantial heat such as within thirty (30) minutes after the heating step has ended. The cooling fluid, such as ambient air, has a temperature at least about 30 F. below, and preferably at least about 50 F. below, the temperature of the heated wood. The evaporation of the heated moisture and steam vapor causes a rapid cooling effect on the processed lumber. The wood or lumber goes from the target temperature to cool-to-the-touch in about five (5) to ten (10) minutes after the cooling fluid is applied to the heated wood. If desired, the lumber could be left in the processing enclosure and allowed to cool down slowly if about 100% humidity is maintained. Testing has shown that the exposure of the heated wood to a cooling fluid at least 30 F. below the temperature of the heated wood within at least about 30 minutes after the wood has been heated to the predetermined temperature for a predetermined time is important to the prevention of stain on a consistent basis. The cooling fluid for minimizing stain on a consistent basis preferably has a RH less than the RH of the heating enclosure. The RH of the cooling fluid should be at least 10% less than the RH of the heating enclosure and preferably about 30% RH less than such heating enclosure. Moreover, the flash off could provide an additional benefit to processed red oak hardwood by providing a tint to the appearance of the hardwood as a harmless orange tint appears on the surface of the wood after about twenty-four (24) hours after flash off.

Time Factor T6

Time period T6 represents the amount of time from the initial cutting of a tree or logs, and the heating of the logs in a heated enclosure with the logs not being sawn into lumber before being processed. In effect, this time duration is similar to time factor T2. Time factors T2 and T6 comprise the "Processing Interval" which has been found to be very important in preventing stains in green wood by holding the time factors T2 or T6 to a minimum. Time factors T1 and T2 are closely related as a maximum time exists from the time that a tree is felled until the lumber from the tree is heated in order to obtain satisfactory results from the process of the present invention in preventing staining.

The total times T1–T4 for lumber has been most effective when less the about five (5) days from the felling of the trees. Longer time periods have been found to be effective but with less satisfactory results.

The following examples comprises actual tests which have been run on various green woods under the present green wood treating process for successfully preventing stains from occurring on wood. The tests involved green logs which were cut into lumber heated in heating enclosure 30 utilizing steam as the fluid medium for heating. The time periods T1–T5 are shown for each of the tests. Result of the tests are shown in the following table:

ACTUAL TEST RESULTS OF SELECTED SPECIES

| Type of Wood | Board Feet in Test | T1 (days) | Process Interval T2 (days) | T3 (hrs) | Target Temp. Deg. F. | T4 (hrs.) | T5 (mins) | Ave. Daily Temp | Ave. Daily R.H | Ave. Daily Dew Pt. |
|---|---|---|---|---|---|---|---|---|---|---|
| Ash | 5,219 | 4*** | 1 | 5 | 159 | 1.75 | 10 | 55 F. | 66% | 45 F. |
| Oak | 6,666 | 1 | 1 | 6 | 160 | 2 | 10 | 65 F. | 73% | 56 F. |
| Maple | 7,144 | 2 | 2 | 6.5 | 165 | 3 | 10 | 65 F. | 73% | 56 F. |
| Ash | 4,700 | 5*** | 3 | 4.2 | 159 | 1.75 | 10 | 55 F. | 66% | 45 F. |
| Oak (white) | 4,733 | 14*** | 2 | 4 | 159 | 3 | 10 | 76 F. | 80% | 71 F. |

-continued

ACTUAL TEST RESULTS OF SELECTED SPECIES

| Type of Wood | Board Feet in Test | T1 (days) | Process Interval T2 (days) | T3 (hrs) | Target Temp. Deg. F. | T4 (hrs.) | T5 (mins) | Ave. Daily Temp | Ave. Daily R.H | Ave. Daily Dew Pt. |
|---|---|---|---|---|---|---|---|---|---|---|
| Oak (red) | 8,813 | 34*** | 4 | 6.5 | 160 | 2.25 | 10 | 76 F. | 80% | 71 F. |
| Oak (red) | 5,416 | 13*** | 4 | 4.2 | 159 | 2 | 10 | 55 F. | 66% | 45 F. |

***denotes logs that were sprinkled to keep wet prior to sawing

Recommended time period ranges for ash, oak and maple hardwood lumber in order to obtain best results for preventing staining are set forth below in the following table:

RECOMMENDED TIME PERIODS FOR SELECTED HARDWOOD SPECIES

| Type of Wood | T1 (days) | Process Interval T2 (days) | T3 (hrs.) | T4 (hrs.) | T5 (mins) | T1 + T2 (days) (not wetted) | Target Temp. | Ave. Daily Temp. | Ave. Daily R.H. |
|---|---|---|---|---|---|---|---|---|---|
| Ash 4/4 | | | | | | | | | |
| Minimum | 0* | 0 | ** | 0 | 0 | 0 | 140 F. | 70 F. | 75% |
| Maximum | 6*** | 5 | ** | 6**** | 15 | 11 | 210 F. | 70 F. | 75% |
| Oak | | | | | | | | | |
| Minimum | 0 | 0 | ** | 0 | 0 | 0 | 130 F. | 70 F. | 75% |
| Maximum | 6*** | 4 | ** | 8**** | 15 | 10 | 210 F. | 70 F. | 75% |
| Maple | | | | | | | | | |
| Minimum | 0 | 0 | ** | 0 | 0 | 0 | 120 F. | 70 F. | 75% |
| Maximum | 3*** | 3 | ** | 6**** | 15 | 6 | 205 F. | 70 F. | 75% |

*Note: When "0" is used for a minimum range, it means less than one of the type of units specified for such range.
**The time period "T3" is a function of equipment and quantity of wood being processed. Testing has shown that T3 takes approx. 1 hr. per every 1,000 board feet of lumber being processed.
***Maximum time[s] shown are for logs that are not kept wet prior to sawing.
****Maximum periods to obtain maximum results.

In the event the logs are not wetted after being cut from the trees, ash lumber must be placed within the heating enclosure within 11 days, oak lumber must be placed within the heating enclosure within 10 days, and maple lumber must be placed within the heating enclosure within 6 days.

Time periods T1 and T2 are closely related as the lumber is required to reach the heating enclosure within a maximum time after the tree is felled. Time period T2 is of particular importance as logs could be immersed in water for a prolonged period of time such as ten (10) days, and yet satisfactory results may be obtained if the lumber is heated within a short period of time (T2) after being cut from the immersed logs.

The process for treating green wood prior to curing including particularly the heating and cooling steps set forth in time factors T4 and T5 has been found to be highly effective in minimizing staining, particularly in hardwoods. The cooling step by the circulation of a cooling fluid which has a temperature at least 30 F. lower than the heated wood about substantially the entire surface area of the timber or wood results in a removal of heated excess moisture and steam vapor to provide a cooling effect on the lumber. The heating and cooling steps unexpectedly result in minimizing staining, particularly in hardwoods, and substantial testing has verified the results in minimizing staining.

Testing has indicated that the wood that has been processed by the present green wood process has a longer storage life (in the green stage). Although the processed wood does begin to lose moisture as any other wood will do that has been stickered, it can be stored for normal pre-drying procedures. The processed lumber could be stored or shipped. This could be of particular benefit to the facilities that saw and ship green lumber, both hardwoods and softwoods.

The present process is believed to kill the parenchyma cells of the sawlog or sawn lumber thereby altering the enzymatic action that causes chemical staining. Further, the present process has been found to kill the fungus in the wood thereby preventing sap stain from occurring. The present process is believed to effect a change or conversion of the food of the tree and other chemical and natural elements present in the parenchyma cells and/or the sapwood thereby hindering, or rendering these parenchyma cells and sapwood useless for, any further action by either enzymes or fungus thereby eliminating staining.

The nutritive substances that make up tree food occur in somewhat complex compounds such as starches, sugars, hemi- celluloses, inulin, fat and proteins. Typically, the character of tree food can be expressed in the following percentages (exclusive of water): approx. 20 percent proteins; approx. 38 percent amides; approx. 30 percent carbohydrates and many other minor chemical and natural elements. The carbohydrates portion includes the starches, sugars and celluloses components of tree food. Starch, produced during photosynthesis, the complex process of conversion of various gases, sunlight, chlorophyll, etc., into tree food, is the major reserve substance of higher plants such as trees. Starch is stored throughout the tree in the form of grains that are sized and shaped characteristic to a specific type of tree.

Testing has shown that when exposed to heat, these starch grains may burst and form a colloidal solution or gel. Exposure to heat can have an effect on other major components of tree food; the proteins. Although they are very complex compounds, proteins coagulate or change into semi-liquids or solids quite easily when exposed to heat. Additionally, inulin forms a colloidal suspension in hot water. Other elements found within the sapwood and heartwood of the tree are affected by exposure to heat as would occur during portions of the present process.

A rather complex organic substance located principally in the heartwood of a tree but also present in the sapwood to some degree are tannins. Although not fully understood, tannins have been classified into two groups: pyrogallic tannins which are derived from and related to pyrogallol and yield this substance when heated and catechic tannins which yield pyrocatechol when heated. Pyrogallic tannins are made principally from the wood of oak trees and chestnut trees but is also derived from the bark of willows and other seed pod and leaf sources throughout the world. Tannins provide a role in the color and preservation of wood. It is believed to be the dominant presence of tannins in the heartwood of a tree that make it resistant to fungal and chemical staining and other forms of deterioration. The present process results in a dissolution of the tannins present in the wood from the heating of the wood while maintaining the moisture content in the wood after felling of the trees without any appreciable moisture loss.

There has been evidence of a reduction of action by the ambrosia beetle as a result of the present green hardwood treating process. Observations have indicated that their actions on the green lumber and logs are reduced when tested in the same location with untreated lumber or logs. It is apparent that internal changes in the wood from the present process have a detrimental effect on such insects' use of the wood or substances in the wood and subsequently on their infestation and growth.

During the entire testing portion of the present process, there has been no incidence of defect or degrade due to fungal or enzymatic stain detected in any of the test lumber that has been processed after such lumber has gone through the entire air drying and kiln drying processes and became a finished product.

While preferred embodiments of the present invention have been illustrated in detail, it is apparent that modifications and adaptions of the preferred embodiments will occur to those skilled in the art. However, it is to be expressly understood that such modifications and adaptations of the preferred embodiments will occur to those skilled in the art. However, it is to be expressly understood that such modifications and adaptations are within the spirit and scope of the present invention as set forth in the following claims.

What is claimed is:

1. A green wood treating process for treating green wood prior to curing for minimizing staining of the green wood; said green wood treating process comprising the following steps:

positioning said green wood within a confined zone for heating;

heating said green wood within said confined zone in a predetermined fluid medium to a predetermined temperature over about 120 F. for a predetermined time period sufficient to provide a generally uniform heating of the green wood;

substantially maintaining the moisture content of said green wood during heating;

applying a cooling fluid to the heated green wood after heating of said green wood to a predetermined temperature for a predetermined time, the cooling fluid having a temperature substantially less than the temperature of the heated green wood; and maintaining the application of the cooling fluid to the wood for a predetermined time period.

2. The green wood treating process as set forth in claim 1 wherein the step of applying a cooling fluid includes cooling said heated green wood with a cooling fluid at least about 30 F. lower than the temperature of the heated wood.

3. The green wood treating process as set forth in claim 1 wherein the step of applying a cooling fluid comprises exposing the heated green wood to ambient air at least about 30 F. lower than the temperature of the wood.

4. The green wood treating process as set forth in claim 1 wherein the step of heating said green wood comprises heating said green wood for at least about two hours.

5. The green wood treating process as set forth in claim 1 wherein said green wood comprises bundles of lumber with each bundle of lumber including a plurality of individual boards spaced from each other to permit the cooling fluid to flow about substantially the entire outer surface area of the boards.

6. The green wood treating process as set forth in claim 1 wherein the step of applying a cooling fluid includes applying a cooling fluid having a relative humidity at least about 10% less than the relative humidity of the confined zone.

7. A green wood treating process for treating green wood prior to curing for minimizing staining of the green wood, the green wood arranged in bundles of lumber with boards spaced from each other; said green wood treating process comprising the following steps:

positioning said bundles of green wood within a heating enclosure for heating;

heating said green wood with steam within said heating enclosure sufficient to provide a generally uniform heating of the green wood to a predetermined temperature over about 120 F. for a predetermined time period sufficient to provide a generally uniform heating of the green wood while substantially maintaining the moisture content of said green wood during heating;

applying cooling air at a temperature at least 30 F. lower than the temperature of the heated wood to the heated green wood for substantially surrounding the separate boards of the green wood after heating of said green wood to a predetermined temperature for a predetermined time; and maintaining the application of the cooled air to the wood for a predetermined time period.

8. The green wood treating process as set forth in claim 7 wherein the step of heating said green wood includes heating said green wood for at least about two hours.

9. The green wood process as set forth in claim 8 wherein the step of applying cooling air comprises the applying of cooling air at a temperature at least 50 F. lower than the temperature of the heated wood.

10. The green wood treating process as set forth in claim 7 wherein the step of applying cooling air includes applying the cooling air within about 30 minutes after heating of said green wood to a predetermined temperature for a predetermined time period.

11. The green wood treating process as set forth in claim 7 wherein the step of applying cooling air includes applying air having a relative humidity at least about 10% less than the relative humidity of the heating enclosure.

12. A green wood treating process for treating wood in a green stage prior to curing for minimizing staining of wood; said green wood treating process comprising the steps of:

cutting trees into logs of a predetermined length;

maintaining the moisture content within said logs without any appreciable loss of moisture in said logs;

positioning said logs within a heating enclosure;

applying a controlled heating fluid at a temperature above about 120 F. to the logs in said heating enclosure for a predetermined period of time sufficient to provide a generally uniform heating of the logs, the heating fluid having a predetermined moisture content sufficient to maintain substantially the moisture content of the logs;

applying a cooling fluid after heating of the logs for substantially surrounding the logs, the cooling fluid having a temperature substantially less than the temperature of the heated logs; and maintaining the application of the cooling fluid to the logs for a predetermined time period.

13. A green wood treating process as set forth in claim 12 wherein the step of maintaining said moisture content within said logs includes continuously wetting said logs with water.

14. The green wood treating process as set forth in claim 12 including the step of applying said cooling fluid within thirty minutes after completion of said predetermined heating time in said heating enclosure.

15. The green wood treating process as set forth in claim 12 wherein the step of heating said logs comprises heating said logs to a temperature between 120 F. and 210 F. for a period of time at least about two hours.

16. The green wood treating process as set forth in claim 12 wherein the wood treating process comprises the felling of hardwood trees and the sawing of logs from said trees; and the step of positioning said logs within a heating enclosure includes the positioning of logs within the heating enclosure within about eleven days after the tree is felled when the logs are not wetted.

17. A green hardwood treating process for treating hardwood in a green state prior to curing for minimizing staining of the hardwood; said green hardwood treating process comprising the following steps:

felling hardwood trees;

cutting said hardwood trees into hardwood logs of a predetermined length;

maintaining said moisture content within said logs without any appreciable loss of moisture in said logs;

sawing said logs into lumber of a predetermined size;

maintaining the moisture content of said lumber without any appreciable loss of moisture;

applying a controlled heating fluid at a temperature above about 120 F. to the lumber in a heating enclosure for a predetermined period of time sufficient to provide a generally uniform heating of the lumber, the heating fluid having a predetermined moisture content sufficient to maintain substantially the moisture content of the lumber;

applying a cooling fluid after heating of the lumber for substantially surrounding the lumber, the cooling fluid having a temperature substantially less than the temperature of the heated lumber; and maintaining the application of the cooling fluid to said lumber for a predetermined time period.

18. The green hardwood treating process as set forth in claim 17 wherein the step of applying a cooling fluid includes applying air at a temperature at least 30 F. lower than the temperature of the heating enclosure, and the step of applying a controlled heating fluid comprises applying steam for at least two hours.

19. A green hardwood treating process as set forth in claim 17 wherein said process comprises treating oak hardwood.

20. A green hardwood treating process as set forth in claim 17 wherein said process comprises treating maple hardwood.

21. A green hardwood treating process as set forth in claim 17 wherein said process comprises treating ash hardwood.

* * * * *